US009212799B2

(12) United States Patent
Todaka et al.

(10) Patent No.: US 9,212,799 B2
(45) Date of Patent: Dec. 15, 2015

(54) LAMP UNIT

(71) Applicants: HONDA MOTOR CO., LTD., Tokyo (JP); STANLEY ELECTRIC CO., LTD., Tokyo (JP)

(72) Inventors: Shinichi Todaka, Raymond, OH (US); Nathan Marion Fisher, Raymond, OH (US); Joshua Thomas Glazier, Raymond, OH (US); Mitsuaki Kiyota, London, OH (US); Robert William Herpy, London, OH (US)

(73) Assignees: Honda Motor Co., Ltd., Tokyo (JP); Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 14/262,009

(22) Filed: Apr. 25, 2014

(65) Prior Publication Data

US 2014/0321147 A1 Oct. 30, 2014

(30) Foreign Application Priority Data

Apr. 25, 2013 (JP) ..... 2013-092233

(51) Int. Cl.
*F21S 8/10* (2006.01)

(52) U.S. Cl.
CPC ..... *F21S 48/12* (2013.01); *F21S 48/1104* (2013.01); *F21S 48/1159* (2013.01); *F21S 48/1216* (2013.01); *F21S 48/1258* (2013.01); *F21S 48/1275* (2013.01); *F21S 48/1352* (2013.01); *F21S 48/1388* (2013.01); *F21S 48/145* (2013.01); *F21S 48/1747* (2013.01); *F21S 48/1305* (2013.01)

(58) Field of Classification Search
USPC ..... 362/516, 517, 518, 520, 522, 543, 544, 362/545, 311.02, 311.06, 327, 328, 329, 362/332, 333, 334, 335, 336
See application file for complete search history.

(56) References Cited

U.S. PATENT DOCUMENTS

| | | | | |
|---|---|---|---|---|
| 1,317,972 | A * | 10/1919 | Griswold | 30/164.9 |
| 2,072,849 | A * | 3/1937 | Dietrich | 362/509 |
| 2,113,553 | A * | 4/1938 | Dover | 362/544 |
| 2008/0144328 | A1 * | 6/2008 | Yagi et al. | 362/516 |
| 2013/0010488 | A1 | 1/2013 | Koizumi | |

FOREIGN PATENT DOCUMENTS

JP 2013-16400 A 1/2013

* cited by examiner

*Primary Examiner* — Laura Tso
(74) *Attorney, Agent, or Firm* — Kenealy Vaidya LLP

(57) ABSTRACT

A lamp unit for a vehicle lamp can include: a lens having an aspherical shape, including a first lens portion, and a second lens portion disposed adjacent to the first lens portion and forming a concave portion on at least a part of a rear side surface thereof; a first reflective surface disposed rearward of the first lens portion; a second reflective surface disposed rearward of the second lens portion; a first light source configured to emit light to be reflected by the first reflective surface, pass through the first lens portion and be emitted forward; and a second light source configured to emit light to be reflected by the second reflective surface, pass through the second lens portion and be emitted forward. A shape of a rear side surface of the second lens portion can be configured to diffuse the light from the second light source vertically and horizontally.

19 Claims, 12 Drawing Sheets

LAMP UNIT

CROSS-REFERENCE TO RELATED APPLICATIONS

This application claims the priority benefit under 35 U.S.C. §119 of Japanese Patent Application No. 2013-092233 filed on Apr. 25, 2013, which is hereby incorporated in its entirety by reference.

BACKGROUND

Description of the Related Art

Conventionally, in the field of lamps, specifically vehicle headlamps (HL), a lamp has been proposed having a configuration that incorporates, in a single unit, an optical system configuring a daytime running lamp (DRL) used for informing someone ahead of the existence of a vehicle during daytime operation, and an optical system configuring such a headlamp.

SUMMARY

The presently disclosed subject matter is designed in view of the above described characteristics and circumstances, and according to one aspect includes a lamp unit for a vehicle lamp with a configuration that incorporates a first light source used for a first lamp function (for example a headlamp) and a second light source used for a second lamp function (for example a daytime running light) in a single unit to realize a reduction in the number of components, to simplify an assembly process, and to reduce assembly errors.

A vehicle lamp according to a first aspect of the disclosed subject matter can include a lens having a basic shape of an aspherical lens including a first lens portion, and a thin second lens portion disposed adjacent to the first lens portion and forming a concave portion on at least a part of a rear side surface of the aspherical lens, a first reflective surface disposed rearward of the first lens portion, a second reflective surface disposed rearward of the second lens portion, a first light source configured to emit light which is to be reflected by the first reflective surface, to pass through the first lens portion and to be emitted forward, and a second light source configured to emit light which is to be reflected by the second reflective surface, to pass through the second lens portion and to be emitted forward, wherein a shape of a rear side surface of the second lens portion is configured so that the light from the second light source reflected by the second reflective surface, passing through the second lens portion and emitted forward is diffused vertically and horizontally.

The subject matter according to the first aspect can provide at least some of the following advantages and characteristics.

First, in a lamp unit for a vehicle lamp with a configuration that incorporates a first light source used for a first lamp function (for example a headlamp) and a second light source used for a second lamp function (for example a daytime running light) in a single unit, a number of components can be reduced, an assembly process can be simplified, and assembly errors can be reduced.

The above advantages/characteristics can be achieved by forming the first lens portion and the second lens portion as a single lens, not as separate and individual lenses.

Second, even though the lamp unit is configured to have a single lens, two lamp functions can be realized.

The subject matter according to the second aspect can be configured such that, in the first aspect, the rear side surface of the second lens includes at least one lens cut.

With the subject matter according to the second aspect, by adjusting a shape of the lens cut, it is possible to adjust an extent of vertical and horizontal diffusion of the light from the second light source which passes through the second lens portion and is emitted forward.

The subject matter according to the third aspect can be configured such that, in the first or second aspect, the shape of the rear side surface of the second lens portion is configured so that the light from the second light source reflected by the second reflective surface, passing through the second lens portion and emitted forward is diffused vertically and horizontally to form at least a portion of a daytime running lamp light distribution pattern.

With the subject matter according to the third aspect, the lamp unit can function as a daytime running lamp.

The subject matter according to the fourth aspect can be configured such that, in any of the first to third aspects, a shape of the first reflective surface is configured so that the light from the first light source emitted forward through the first lens portion forms at least a portion of a headlamp light distribution pattern.

With the subject matter according to the fourth aspect, the lamp unit can function as a headlamp.

The subject matter according to the fifth aspect can be configured such that, in any of the first to fourth aspects, a front side surface of the lens is configured so that a front side surface of the first lens portion and a front side surface of the second lens portion form a common single lens surface that continues smoothly.

With the subject matter according to the fifth aspect, even though the lamp unit is configured to have a single lens, two lamp functions can be realized.

The subject matter according to the sixth aspect can be configured such that, in any of the first to fifth aspects, the lamp unit further includes a light shielding portion configured to shield at least a portion of light from the second light source to the first lens portion.

When a portion of the light from the second light source passes through the first lens portion and is reflected forward and obliquely upward by an extension disposed on a periphery of the lamp unit, glare can be caused by the portion of the light. With the subject matter according to the sixth aspect, such glare can be suppressed.

The subject matter according to the seventh aspect can be configured such that, in any of the first to sixth aspects, the shape of the second reflective surface is configured so that light from the second light source reflected by the second reflective surface condenses forward or rearward of the second lens portion.

With the subject matter according to the seventh aspect, a size of the second lens portion can be smaller than that compared to when the light from the second light source is not made to condense. As a result, a size of the first lens portion can be made larger.

According to the presently disclosed subject matter, in a lamp unit for a vehicle lamp with a configuration that incorporates a first light source used for a first lamp function (for example a headlamp) and a second light source used for a second lamp function (for example a daytime running light) in a single unit, a number of components can be reduced. Further, an assembly process can be simplified, and assembly errors can be reduced.

BRIEF DESCRIPTION OF THE DRAWINGS

FIG. 1 is a front view of a vehicle headlamp made in accordance with principles of the presently disclosed subject matter and disposed on a left-hand side from among vehicle headlamps disposed on a right-hand side and a left-hand side of a front portion of a vehicle such as an automobile and the like;

DETAILED DESCRIPTION OF EXEMPLARY EMBODIMENTS

Figure 1:
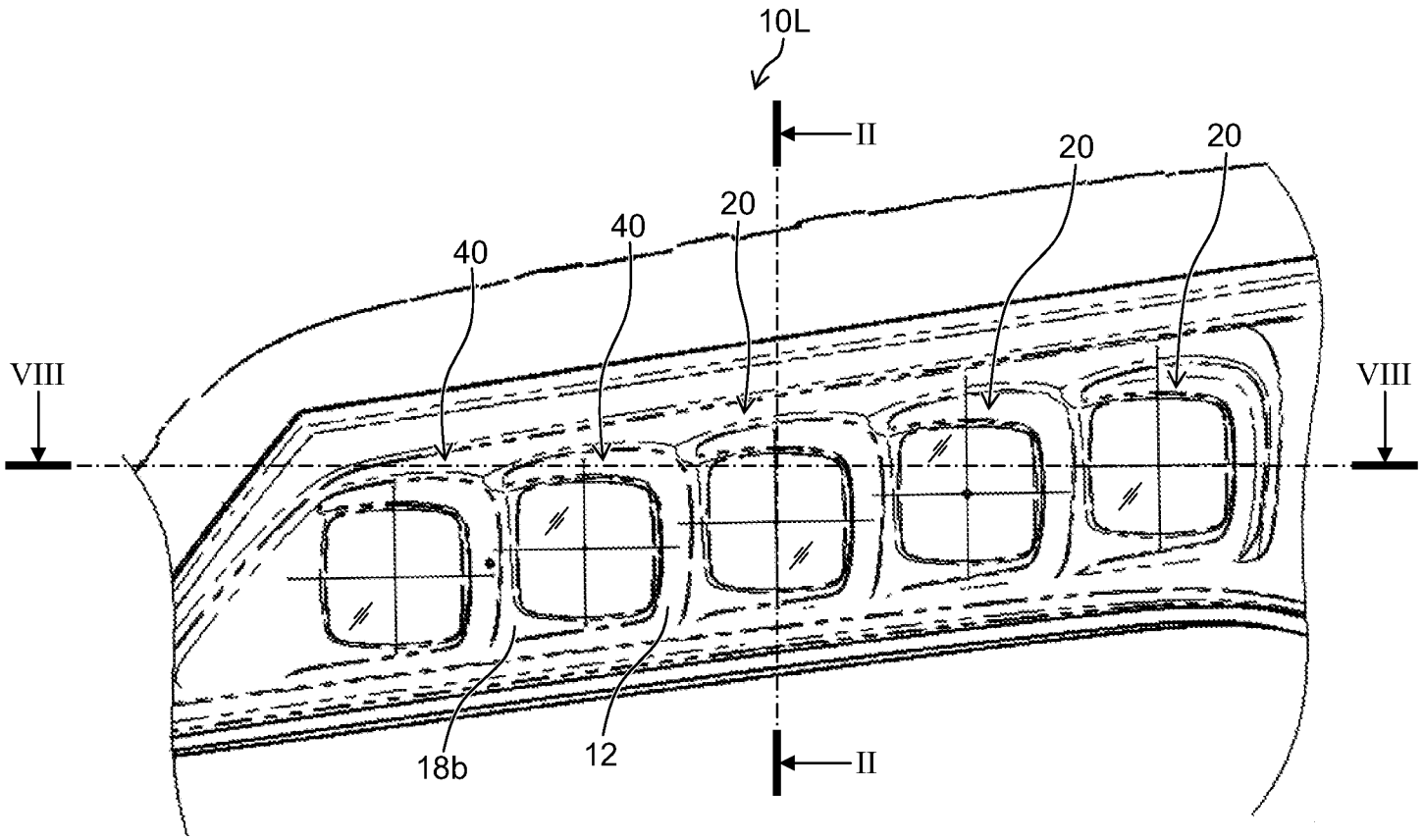
Figure 2:
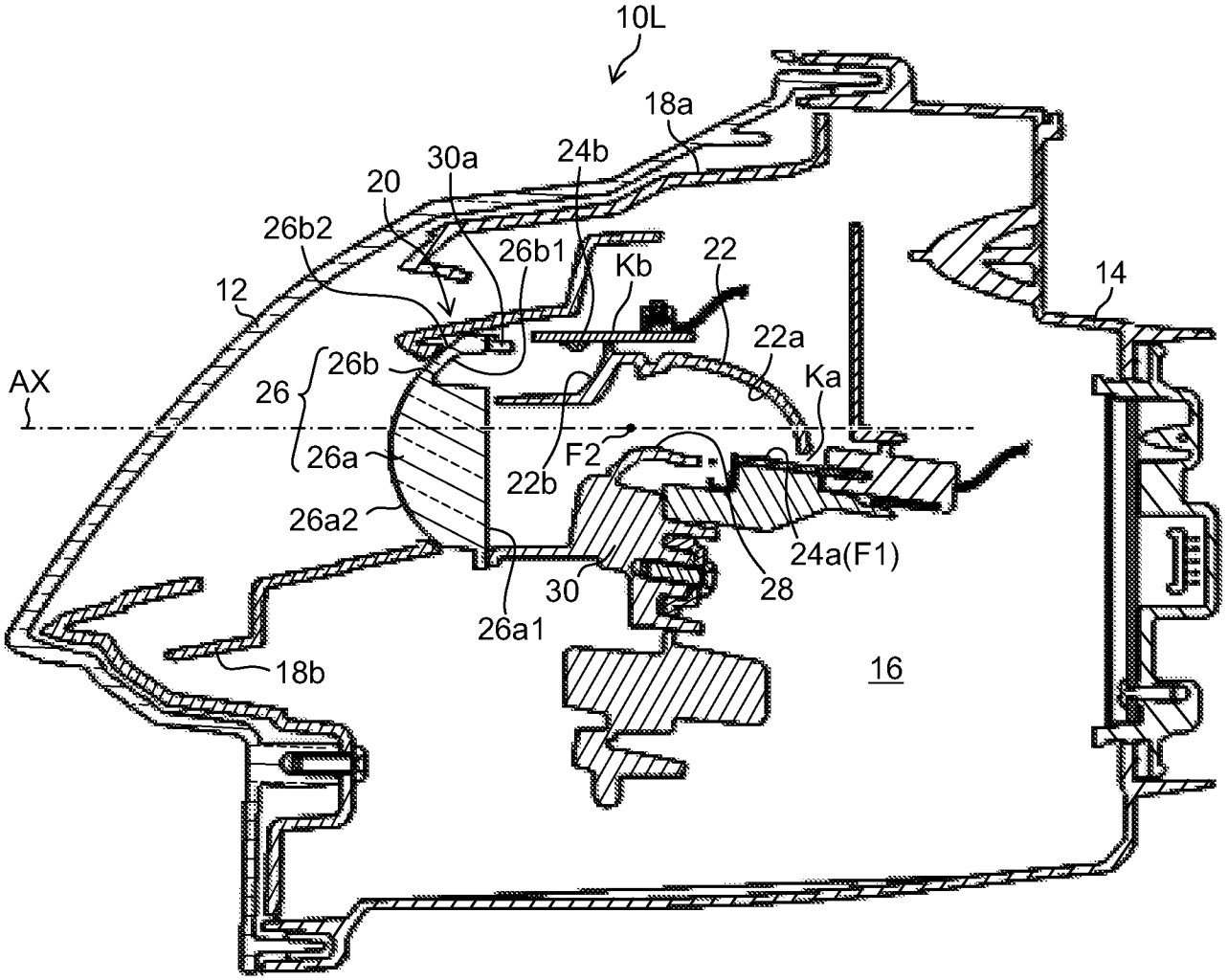
FIG. 2 is a cross-sectional view of a vehicle headlamp taken along line II-II in FIG. 1.

An exemplary embodiment of the presently disclosed subject matter of a lamp unit for a vehicle headlamp will be described below with reference to the drawings. FIG. 1 is a front view of a vehicle headlamp 10L disposed on a left-hand side from among vehicle headlamps disposed on a right-hand side and a left-hand side of a front portion of a vehicle such as an automobile and the like. FIG. 2 is a cross-sectional view of the vehicle headlamp 10L taken along line II-II in FIG. 1.

The vehicle headlamp 10L disposed on the left-hand side and the vehicle headlamp 10R disposed on the right-hand side can be laterally symmetrical with each other and configured substantially identical to each other. Therefore, the below description will center on the vehicle headlamp 10L disposed on the left-hand side, and a description of the vehicle headlamp 10R configured on the right-hand side will be omitted.

As illustrated in FIG. 1, the vehicle headlamp 10L can include three combined passing & driving beam lamp units 20 which can be used for emitting both a driving beam (i.e., a beam used, for example, in nighttime driving on a country road when the lamp is used to illuminate the road ahead over a long distance) and a passing beam (i.e., a beam used, for example, in nighttime driving when in traffic and/or when the lamp is used to illuminate the road ahead of the vehicle without causing undue dazzle or discomfort to oncoming drivers or other road users), and two driving beam lamp units 40. When viewed from a lamp front surface, each of the lamp units 20 and 40 is disposed lined up in a row diagonally in an upper right direction inside a lamp chamber 16. The lamp chamber 16 can be configured by combining an outer lens 12 (translucent cover) made of transparent resin and a housing 14, as illustrated in FIG. 2. A periphery around each lamp unit 20 and 40 can be encompassed by a first extension 18*a* and a second extension 18*b* which are decorative members having undergone a mirror finish of aluminum deposition or the like on surfaces thereof. Note that a number of the lamp units 20 and a number of the lamp units 40 may be any appropriate number.

First, an exemplary combined passing & driving beam lamp unit 20 which can be used for emitting both a passing beam and a driving beam will be described.

Figure 3:
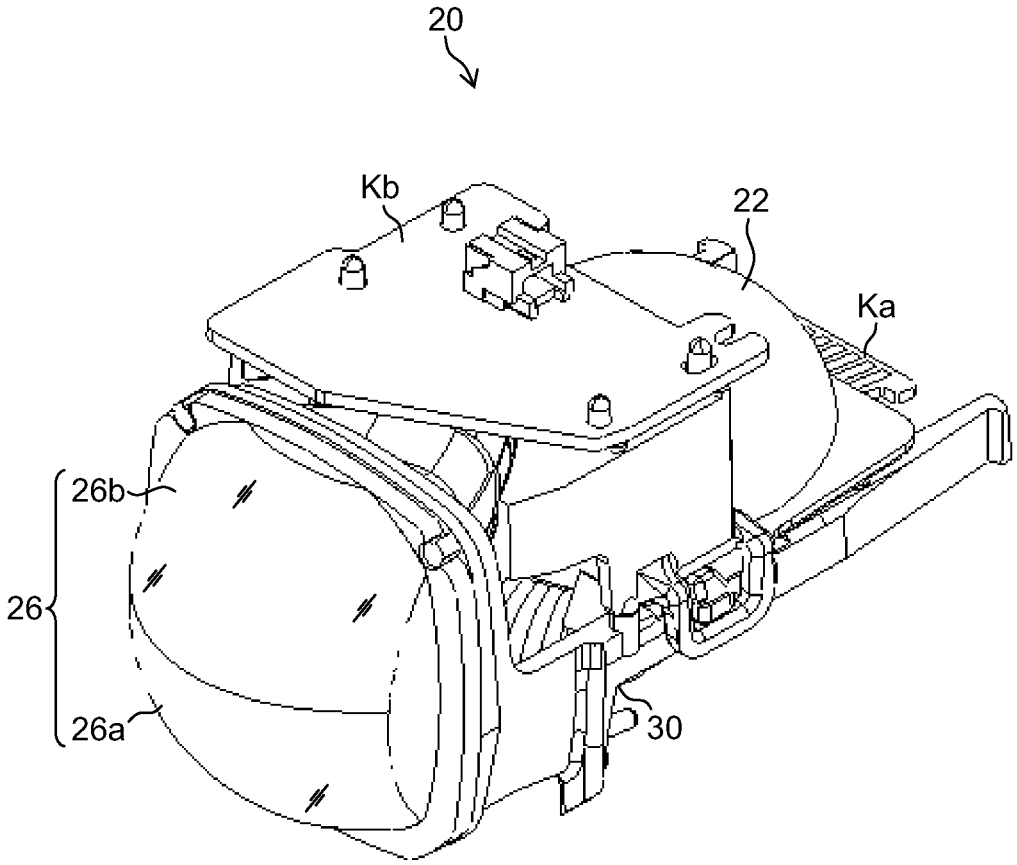
FIG. 3 is a perspective view of a combined passing & driving beam lamp unit made in accordance with principles of the presently disclosed subject matter and which can be used for emitting both a driving beam and a passing beam.
Figure 4:
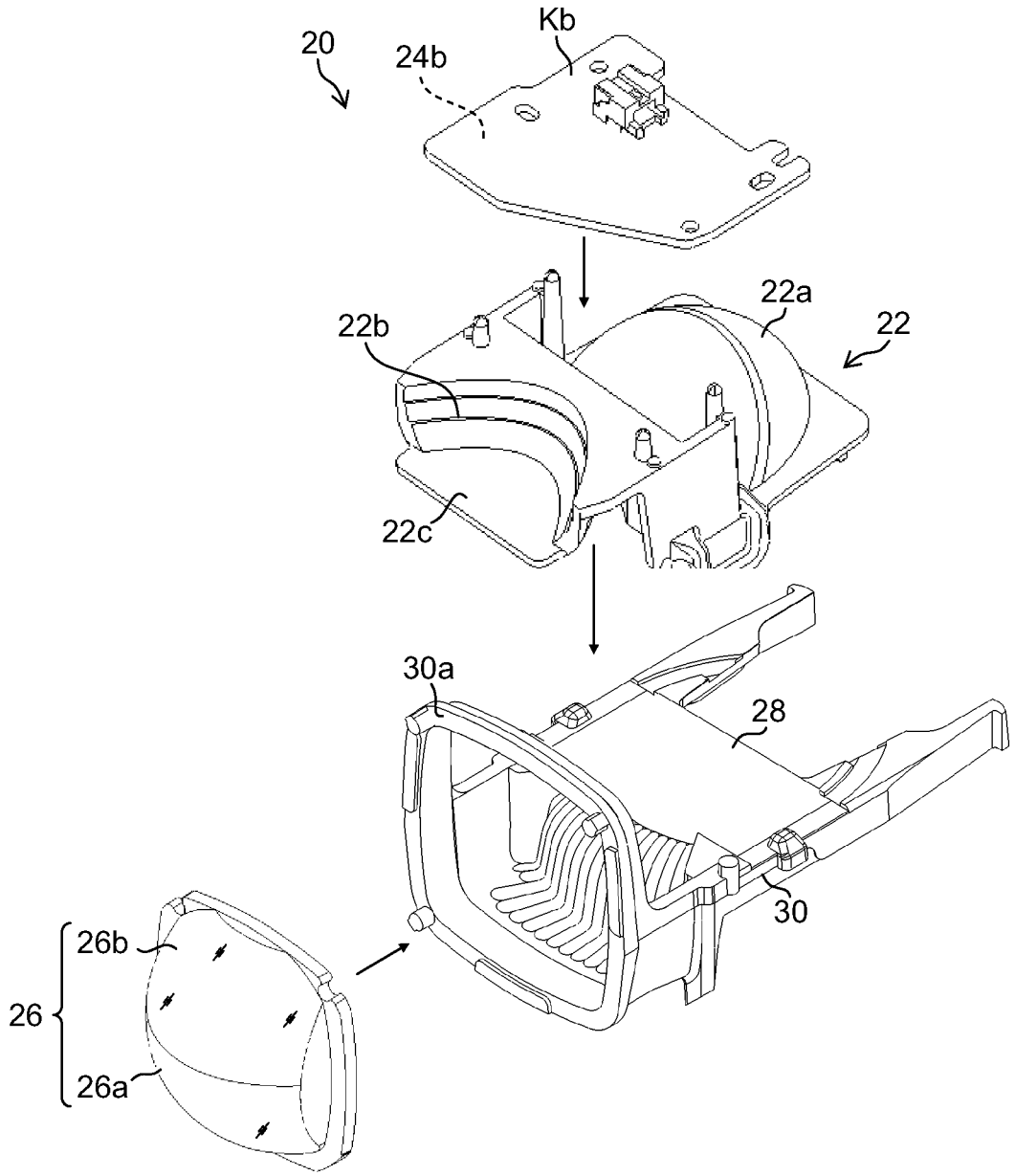
FIG. 4 is an exploded perspective view of the combined passing & driving beam lamp unit of FIG. 3.

FIG. 3 is a perspective view of an exemplary combined passing & driving beam lamp unit 20, and FIG. 4 is an exploded perspective view of the combined passing & driving beam lamp unit 20. FIG. 5B illustrates an example of a passing beam light distribution pattern P1 (in a case of right-hand traffic) formed by light emitted from the combined passing & driving beam lamp unit 20 onto a virtual vertical screen (disposed about 25 meters forward from a vehicle front surface) directly facing the vehicle front surface; FIG. 5D illustrates an example of a daytime running lamp light distribution pattern P2; and FIG. 5E illustrates an example of a passing beam light distribution pattern P1 (in a case of left-hand traffic).

The combined passing & driving beam lamp unit 20 is a lamp unit configured so that the passing beam light distribution pattern P1 or the daytime running lamp light distribution pattern P2 is formed. In other words, the combined passing & driving beam lamp unit 20 is configured as a lamp unit having a configuration that incorporates a first light source 24*a* used for a first lamp function (headlamp function) and a second light source 24*b* used for a second lamp function (daytime running lamp function) in a single unit.

As illustrated in FIGS. 2 and 4, the combined passing & driving beam lamp unit 20 can include a reflector 22, a first light source 24*a* (not shown in FIG. 4), a second light source 24*b*, a lens 26 disposed on an optical axis AX that extends in a front to rear direction of the vehicle, a light shielding member 28 (also referred to as a shade) that shields light traveling upward from among light from the first light source 24*a* emitted forward passing through a first lens portion 26*a*, and a holding member 30 that holds these structures. Adjusting the shape of the light shielding member 28 allows an upper edge (cut-off line) of the passing beam light distribution pattern P1 to become a shape illustrated in FIG. 5B or a shape illustrated in FIG. 5E.

The reflector 22 can be configured of a single member that includes a first reflective surface 22*a*, a second reflective surface 22*b*, and a light shielding portion 22*c*. The reflective surfaces 22*a* and 22*b* can be formed by conducting a mirror finish of aluminum deposition or the like on a reflector base material (including the light shielding portion 22*c*) that can be integrally molded using a mold.

Since the reflective surfaces 22*a*, 22*b*, and the light shielding portion 22*c* are configured as a single member in this embodiment, the total number of components is reduced, the assembly process is simplified, and assembly errors are reduced, compared to a case where the reflective surfaces 22*a*, 22*b*, and the light shielding portion 22*c* are configured as a plurality of separate parts. Please note that the first light source 24*a* can be configured to direct light in an upward direction about a first light emitting axis, and the second light source 24*b* can be configured to direct light in a downward direction substantially opposed to the upward direction and about a second light emitting axis. The first and second light emitting axes can be parallel to each other and substantially perpendicular to the forward light emitting direction of the lamp. In addition, the first light source 24*a* can be located rearward and further from a center of the lens 26 than the second light source 24*b*. The first reflective surface 22*a* and second reflective surface 22*b* can be incorporated into a single continuous homogenous structure that extends from the first light source 24*a* to the second light source 24*b* and intersects both the first light emitting axis and second light emitting axis. Note that the reflective surfaces 22*a*, 22*b*, and the light shielding portion 22*c* are not necessarily formed by one-piece molding, and can be constructed using various other techniques, including welding, machining, attachment structures, etc. The reflective surfaces 22*a*, 22*b*, and the light shielding portion 22*c* may be configured as individual parts, and may be configured by combining these individual parts. The reflector 22 is fixed to the holding member 30 by its peripheral lower edge portion.

Figure 6:
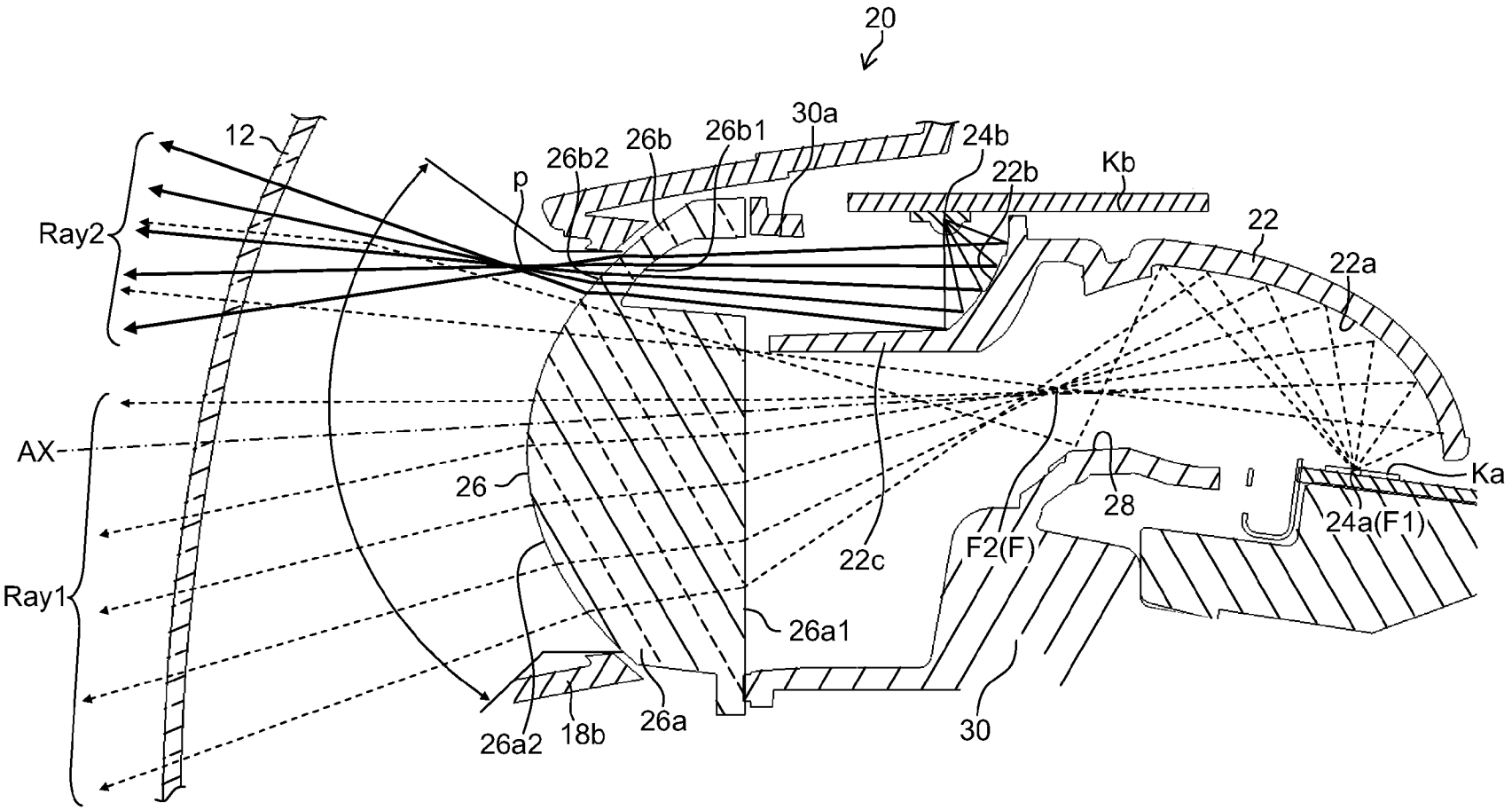
FIG. 6 is a vertical cross-sectional view illustrating optical paths of reflected light from reflective surfaces of the exemplary lamp unit shown in FIG. 4.

FIG. 6 is a vertical cross-sectional view illustrating optical paths of reflected light from the reflective surfaces 22*a* and 22*b*.

As illustrated in FIG. 6, the first reflective surface 22*a* (corresponding to a headlamp reflective surface of the presently described embodiment) is a reflective surface which reflects light rays (Ray 1) from the first light source 24*a* to the front, toward the optical axis AX so that the light rays (Ray 1) condense near a rear focal point F of the first lens portion 26*a*. Specifically, the first reflective surface 22*a* can be a spheroidal reflective surface (a spheroid, a free-form surface similar to this, or the like) where a cross section thereof includes the optical axis AX and has an elliptical shape including a first focal point F1 and a second focal point F2, and an eccentricity thereof is set to gradually increase from the vertical cross section to the horizontal cross section.

The first reflective surface 22*a* can be disposed rearward of the first lens portion 26*a*. The first reflective surface 22*a* covers a region from lateral sides of the first light source 24*a* to a top of the first light source 24*a* in a dome shape (excluding in a vehicle front side region through which a reflected light from the first reflective surface 22*a* passes) so that light from the first light source 24*a* emitted upward (e.g., in a hemispherical direction) is incident thereto.

The first light source 24*a* is a light source that emits light that is reflected forward by the first reflective surface 22*a* toward the optical axis AX, becomes incident to an inner portion of the first lens portion 26*a* from a rear side surface 26*a*1 of the first lens portion 26*a*, and is transmitted forward by exiting from a front side surface 26*a*2.

For example, the first light source 24*a* is a semiconductor light emitting element such as an LED (for example, four light emitting diodes that include a light emitting surface of 1 mm square). The semiconductor light emitting element may be a semiconductor light emitting element having a structure that combines an LED (light emitting diode) (or a laser diode) which emits blue light or light of a color similar to blue, and a fluorescent body (for example, a YAG (Yttrium Aluminum Garnet) fluorescent body) which covers the LED (or the laser diode) and emits yellow light or light of a color similar to yellow. Or, the semiconductor light emitting element may be a semiconductor light emitting element having a structure that combines LEDs (or laser diodes) of three colors of R (red), G (green), and B (blue). Or, the semiconductor light emitting element may be a semiconductor light emitting element having another structure. Note that there may be one or more semiconductor light emitting elements.

The first light source 24*a* can be mounted on a top surface of a substrate (for example, printed wiring board, or printed circuit board) Ka fixed to a holding member 30 or the like with a light emitting surface thereof facing upward and is disposed on a first focal point F1 (or a vicinity thereof) of the first reflective surface 22*a*.

Note that the first light source 24*a* may be a light source other than a semiconductor light emitting element. The first light source 24*a* may be a bulb type light source such as a discharge bulb, halogen bulb, or the like.

Figure 7:
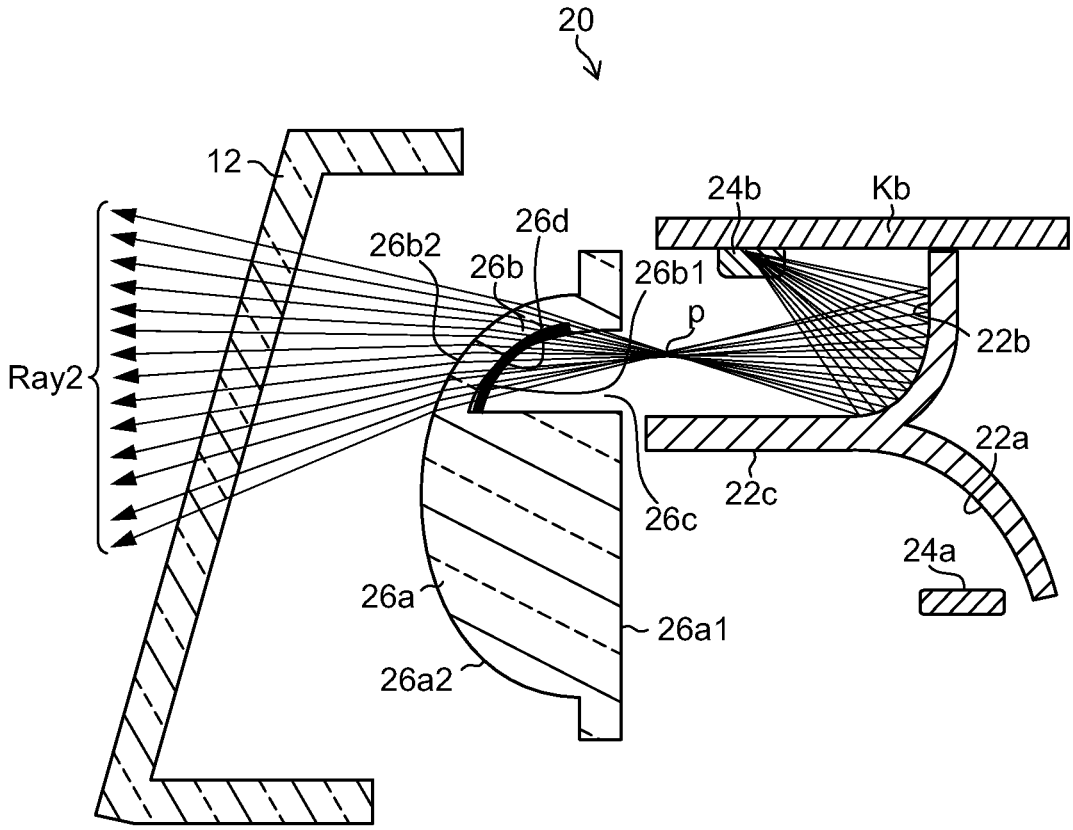
FIG. 7 is a vertical cross-sectional (simplified) view illustrating optical paths of reflected light from a second reflective surface of the exemplary lamp unit shown in FIG. 4.
Figure 8:
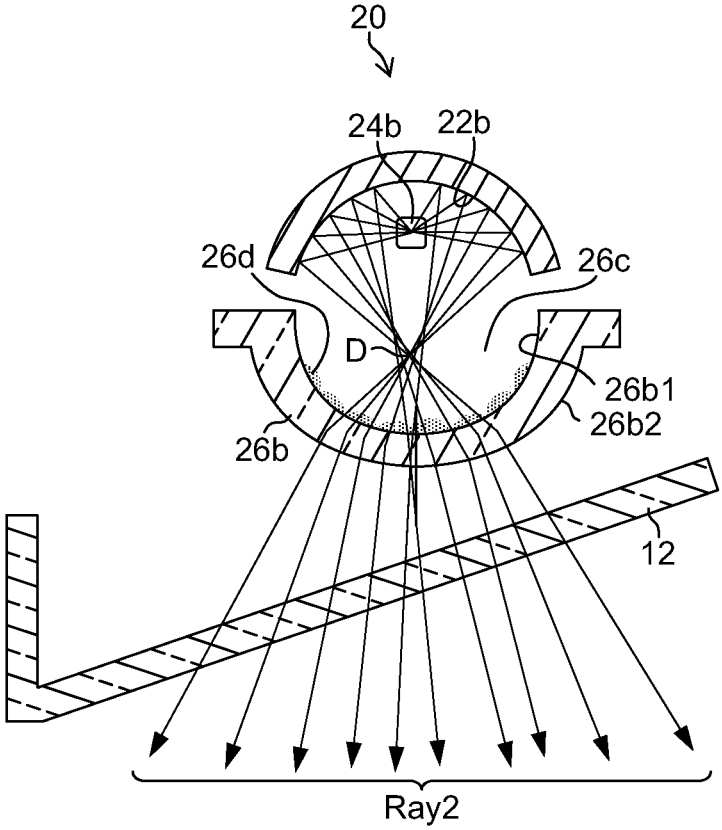
FIG. 8 is a horizontal cross-sectional view illustrating optical paths of the reflected light from the second reflective surface (a cross-sectional (simplified) view of the vehicle headlamp taken along a line VIII-VIII in FIG. 1)

FIGS. 7 and 8 are views illustrating exemplary optical paths of reflected light from the reflective surfaces 22*a* and 22*b*.

The second reflective surface 22*b* (for example, an ellipsoidal reflector) is a reflective surface with a surface shape thereof configured so that light rays (Ray 2) (see FIGS. 6, 7, 8) from the second light source 24*b* reflected by the second reflective surface 22*b* condense forward or rearward of the second lens portion 26*b*. A position p where the light rays (Ray 2) from the second light source 24*b* condense may be forward of the second lens portion 26*b*, as illustrated in FIG. 6, or rearward of the second lens portion 26*b*, as illustrated in FIGS. 7 and 8.

By condensing the light rays (Ray 2) from the second light source 24*b* in this manner, a size of the second lens portion 26*b* can be made smaller than that compared to when the light from the second light source 24*b* is not made to condense. As a result, a size of the first lens portion 26*a* can be made larger.

The second reflective surface 22*b* can be disposed in a position that is rearward of the second lens portion 26*b* and that does not shield the reflected light from the first reflective surface 22*a*. The second reflective surface 22*b* is, for example, a multi-reflector (composite reflective surface). Note that the second reflective surface 22*b* may be a spheroidal reflective surface such as a single elliptical surface, a composite elliptical surface or the like where the first focal point is positioned at a vicinity of the second light source 24*b* and the second focal point is positioned on the position p where the light rays (Ray 2) from the second light source 24*b* condense.

Figure 9:
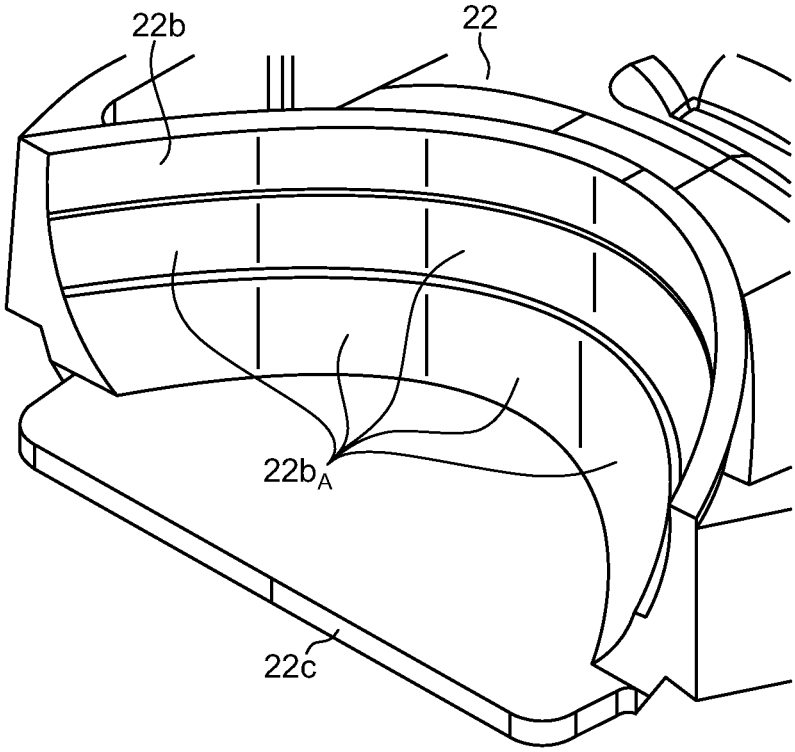
FIG. 9 is an enlarged perspective view of the second reflective surface of the exemplary lamp unit shown in FIG. 4.

FIG. 9 is an enlarged perspective view of the second reflective surface 22*b*.

In the present embodiment, as illustrated in FIG. 9, the second reflective surface 22*b* is configured not as a single curved surface (for example, a free-form surface, a parabolic surface, or an elliptical surface) but as a reflective surface (multi-reflector) that includes a plurality of rectangular reflective regions $22b_A$ divided by a horizontal surface and a vertical surface in a reticular pattern. A shape of the surface of each reflective region $22b_A$ is adjusted so that the light rays (Ray 2) (see FIG. 6), which are emitted from the second light source 24*b*, are reflected by the reflective region $22b_A$, pass through the second lens portion 26*b* and are transmitted forward, such that the rays are directed toward a measurement point established by standards regarding daytime running lamp light distribution patterns. A direction in which the light rays (Ray 2), which are emitted from the second light source 24*b*, passes through the second lens portion 26*b* and are emitted forward, travel can be adjusted by adjusting, for each reflective region $22b_A$, for example, a size of a curvature of a vertical cross section of the reflective region $22b_A$ and/or a size of a curvature of a horizontal cross section of the reflective region $22b_A$.

As described above, by configuring the second reflective surface 22*b* as a reflective surface that includes the plurality of reflective regions $22b_A$, a lamp unit can be designed, which complies with various national regulations whose light distribution standards are different from each other, without drastically changing an outer appearance of the second reflective surface 22*b* (more specifically, without changing a range of each reflective region $22b_A$), compared to when configuring the second reflective surface 22*b* as a single curved surface (for example a free-form surface, parabolic surface, or elliptical surface). For example, conformity with various national regulations whose distribution standards differ is enabled by adjusting the size of the curvature of the vertical cross section and/or the size of the curvature of the horizontal cross section of the reflective region $22b_A$ while maintaining a size of individual reflective regions $22b_A$.

The second light source 24*b* is a light source that emits light that is to be reflected by the second reflective surface 22*b*, incident to an inner portion of the second lens portion 26*b* from a rear side surface 26*b*1 of the second lens portion 26*b*, and transmitted from a front side surface 26*b*2 to be directed forward.

For example, the second light source 24*b* is a semiconductor light emitting element such as an LED (for example, one light emitting diode that includes a light emitting surface of 1 mm square). The semiconductor light emitting element may be a semiconductor light emitting element having a structure that combines an LED (or a laser diode) which emits blue light or light of a color similar to blue, and a fluorescent body (for example, the YAG fluorescent body) which covers the LED (or the laser diode) and emits yellow light or light of a color similar to yellow. Or, the semiconductor light emitting element may be a semiconductor light emitting element having a structure that combines LEDs (or laser diodes) of three colors of RGB. Or, the semiconductor light emitting element may be a semiconductor light emitting element having another structure. Note that there may be one or more semiconductor light emitting elements.

The second light source 24*b* can be mounted on a bottom surface of a substrate Kb (for example, printed wiring board, or printed circuit board) fixed to an upper portion of the reflector 22, with a light emitting surface thereof facing downward, and disposed above the second reflective surface 22*b*.

Note that the second light source 24*b* may be a light source other than a semiconductor light emitting element. The second light source 24*b* may be a bulb type light source such as an incandescent bulb, or the like.

The lens 26 can be a lens made of transparent resin such as acrylic; can have a basic shape of an aspherical lens that includes a front side surface (convex surface), a rear side surface (for example, a plane), and a rear side focal point F positioned at a side of a rear side surface; and can be physically configured as one lens that includes a first lens portion 26*a*, a thin second lens portion 26*b* disposed adjacent to a top portion of the first lens portion 26*a* by forming a concave portion 26*c* on at least a portion of the rear side surface of the aspherical lens. By physically configuring each lens portion 26*a*, 26*b* as one lens, the number of components can be reduced, the assembly process can be simplified, and assembly errors can be reduced, compared to when each lens portion 26*a*, 26*b* is physically configured as separate individual lenses.

The lens 26 can be fixed to a lens holder 30*a*, which is a portion of the holding member 30, and disposed on the optical axis AX that extends in the vehicle longitudinal direction.

Figure 10:
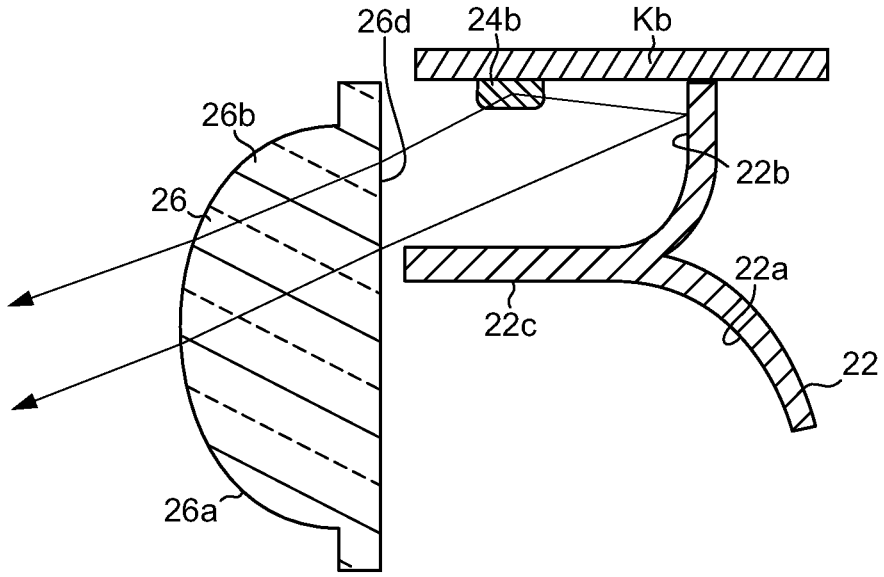
FIG. 10 is a diagram depicting certain technical characteristics and significance for making a second lens portion to be thin.

FIG. 10 is a diagram depicting a technical significance for making the second lens portion 26*b* to be thin.

The second lens portion 26*b* can be made thin because if the second lens portion 26*b* is not made thin, as illustrated in FIG. 10, in a positional relationship of the lens 26 with the second light source 24*b* of the present embodiment, all of the light from the second light source 24*b* is refracted downward and cannot satisfy a distribution performance as required for the daytime running lamp light distribution pattern.

As a thickness of the second lens portion 26*b* is made thinner, control of the light that passes through the second lens portion 26*b* becomes easier and a controllable range of the light becomes larger, but, meanwhile, formability of the second lens portion 26*b* decreases. In the present embodiment, to balance these two effects, the thickness of the second lens portion 26*b* is made to be about 2 mm.

It is desired that a position and range where the concave portion 26*c* is formed (the second lens portion 26*b*) is a position and range where an influence on the reflected light rays (Ray 1) from the first reflective surface 22*a* becomes extremely small. In the present embodiment, for such a position and range, a range that is oblong when viewed from a top portion and the front of the lens 26 is selected.

The front side surface of the lens 26 can be configured as a common single lens surface (convex surface) where the front side surface 26*a*2 of the first lens portion 26*a* and the front side surface 26*b*2 of the second lens portion 26*b* continue smoothly.

As illustrated in FIGS. 7 and 8, the light rays (Ray 2), which are emitted from the second light source 24*b*, pass through the second lens portion 26*b* and are transmitted forward, dispersed vertically and horizontally and form at least a portion of the daytime running lamp light distribution pattern.

To realize this, a shape of the surface of the rear side surface 26*b*1 of the second lens portion 26*b* (more specifically, a bottom surface of the concave portion 26*c*) is configured so that the light rays (Ray 2), which are emitted from the second light source 24*b*, are reflected by the second reflective surface 22*b*, pass through the second lens portion 26*b* and are transmitted forward, are dispersed vertically and horizontally, and form at least a portion of the daytime running lamp light distribution pattern. Specifically, the rear side surface 26*b*1 of the second lens portion 26*b* (more specifically, the bottom surface of the concave portion 26*c*) can be configured to include at least one lens cut (a plurality of lens cuts 26*d* in the present embodiment). Note that the rear side surface 26*b*1 of the second lens portion 26*b* (more specifically, the bottom surface of the concave portion 26*c*) may be configured as a free curve surface where the light rays (Ray 2), which are emitted from the second light source 24*b*, pass through the second lens portion 26*b* and are transmitted forward, are dispersed vertically and horizontally to form at least a portion of the daytime running lamp light distribution pattern.

Figure 11:
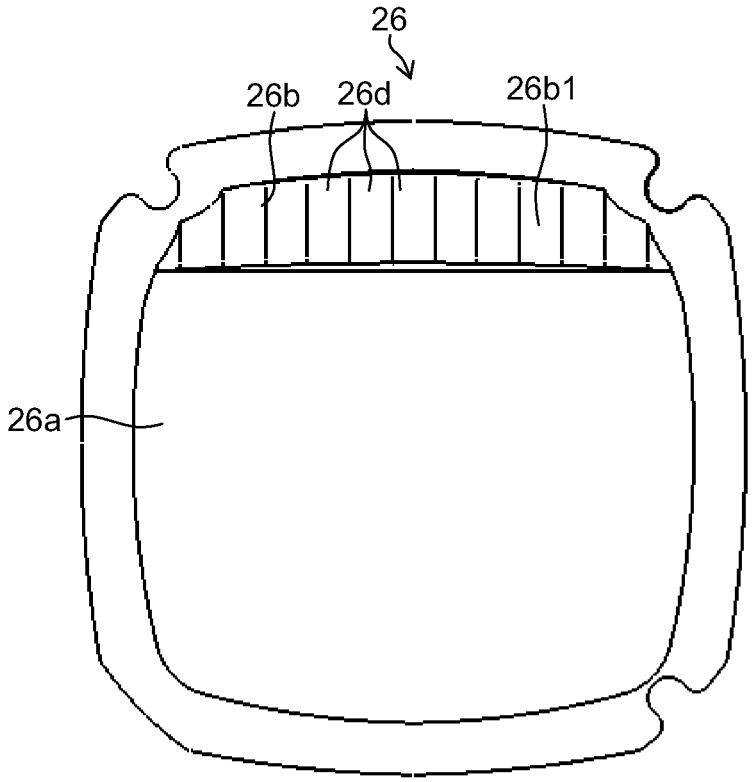
FIG. 11 is a rear view of an exemplary lens made in accordance with principles of the disclosed subject matter.

FIG. 11 is a rear view of the lens 26.

As illustrated in FIG. 11, each lens cut 26*d* can be disposed adjacently in a horizontal direction on the rear side surface 26*b*1 of the second lens portion 26*b* (more specifically, the bottom surface of the concave portion 26*c*). Each lens cut 26*d* can be configured as a lens cut (also referred to as a fluted cut) with an elongated shape that extends substantially vertically along the front side surface of the lens 26 (the front side surface 26*b*2 of the second lens portion 26*b*) where a vertical cross section thereof is concave (see FIG. 7) and a horizontal cross section thereof is convex (see FIG. 8).

An extent of dispersion in a vertical direction of the light emitted forward by being transmitted from the front side surface 26*b*2 of the second lens portion 26*b* can be adjusted by, for example, adjusting a value of a curvature of the concave shape that is the vertical cross section of each lens cut 26*d*. Similarly, an extent of dispersion in a horizontal direction of the light emitted forward by being emitted from the front side surface 26*b*2 of the second lens portion 26*b* can be adjusted by, for example, adjusting a value of a curvature of the convex shape that is the horizontal cross section of each lens cut 26*d*.

The first lens portion 26*a* can be an aspherical lens that includes the front side surface 26*a*2, the rear side surface 26*a*1 (for example, a plane), and the rear side focal point F positioned at a side of the rear side surface 26*a*1, and the first lens portion 26*a* projects forward a light source image formed on a rear side focal point surface as an inverted image. The rear side focal point F of the first lens portion 26*a* can be positioned near the second focal point F2 of the first reflective surface 22*a*.

Figure 12:
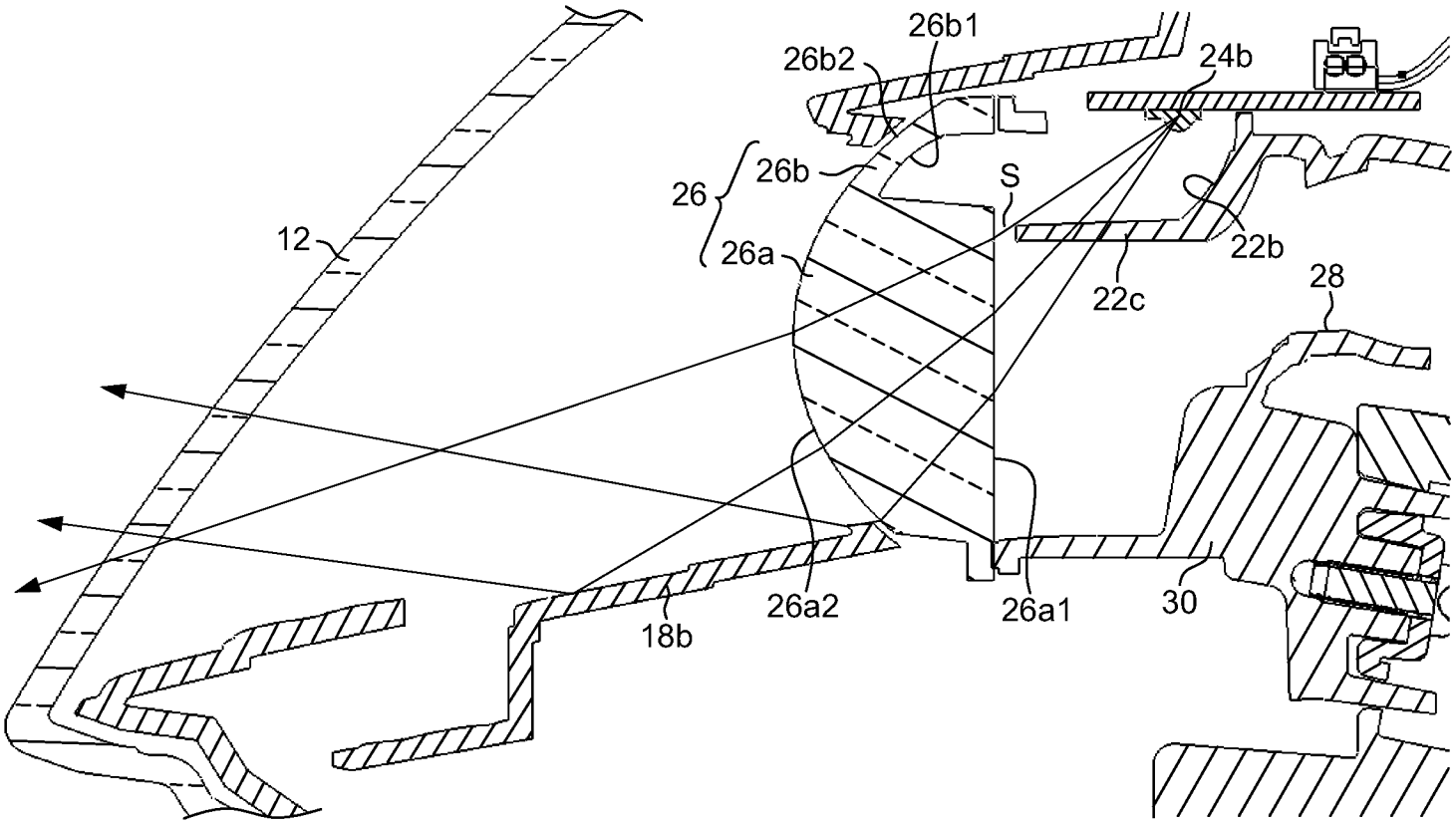
FIG. 12 is a diagram depicting certain technical characteristics and significance of a light shielding portion made in accordance with principles of the disclosed subject matter.

FIG. 12 is a diagram depicting a technical significance of the light shielding portion 22*c*.

As illustrated in FIG. 12, there is concern that a portion of the light (a direct light or a reflected light) from the second light source 24*b* that passes through the first lens portion 26*a*, is reflected in a forward and obliquely upward direction by the second extension 18*b* (bottom surface), and becomes a cause of glare. To prevent this, the shield portion 22*c* that shields at least a portion of the light traveling toward the first lens portion 26*a* from the second light source 24*b* can be disposed rearward of the lens 26 and between the second lens portion 26*b* and the first lens portion 26*a*.

The light shield portion 22*c* can extend substantially horizontally toward the lens 26 from a bottom edge of the second reflective surface 22*b* to a position where the reflected light from the first reflective surface 22*a* is not shielded. Note that a clearance gap S is formed between the lens 26 and the light shield portion 22*c* and that a portion of the light from the second light source 24*b* that passes through this clearance gap S is transmitted through the first lens portion 26*a*. However, this light that passes through the clearance gap S and is transmitted through the first lens portion 26*a* does not become a source of glare because it is not reflected by the second extension 18*b*.

Next, an exemplary driving beam lamp unit 40 will be described.

Figure 5A:
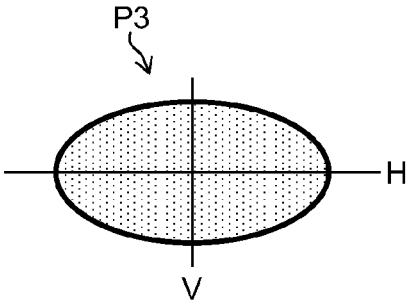
FIG. 5A illustrates an example of a condensing region P3 in a driving beam light distribution pattern formed onto a virtual vertical screen (disposed about 25 meters forward from a vehicle front surface) directly facing the vehicle front surface by light emitted from a driving beam lamp unit made in accordance with principles of the presently disclosed subject matter.
Figure 5D:
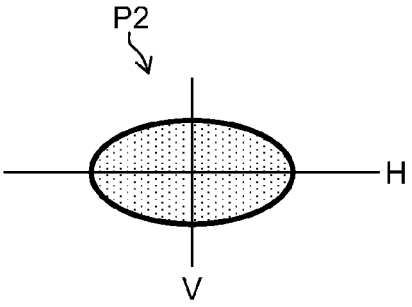
FIG. 5D illustrates an example of a daytime running lamp light distribution pattern P2 formed onto the virtual vertical screen by light emitted from the combined passing & driving beam lamp unit and the lamp unit.
Figure 5B:
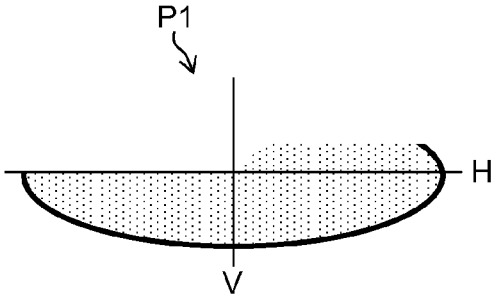
FIG. 5B illustrates an example of a passing beam light distribution pattern P1 (in a case of right-hand traffic) formed onto the virtual vertical screen (disposed about 25 meters forward from the vehicle front surface) directly facing the vehicle front surface by light emitted from a combined passing & driving beam lamp unit made in accordance with principles of the presently disclosed subject matter.
Figure 5E:
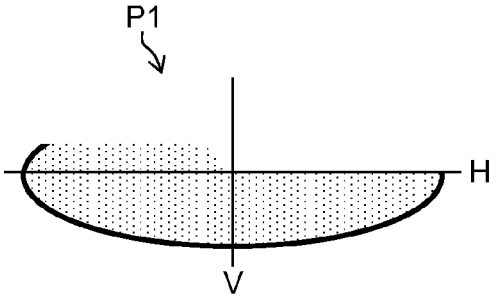
FIG. 5E illustrates an example of a passing beam light distribution pattern P1 (in a case of left-hand traffic) formed onto the virtual vertical screen by light emitted from the lamp unit which can be used for emitting both a driving beam and a passing beam.

FIG. 5A is an example of a condensing region P3 in a driving beam light distribution pattern formed on a virtual vertical screen (disposed about 25 meters forward from the vehicle front surface) directly facing the vehicle front surface by light emitted from the driving beam lamp unit 40, and FIG. 5D is an example of a daytime running lamp light distribution pattern P2.

The driving beam lamp unit 40 is a lamp unit configured to form the condensing region P3 in the driving beam light distribution pattern or the daytime running lamp light distribution pattern P2. More specifically, the driving beam lamp unit 40 can be configured as a lamp unit in which the first light source 24*a* used for the first lamp function (headlamp function) and the second light source 24*b* used for the second lamp function (daytime running lamp function) are combined in a single unit.

Compared to the combined passing & driving beam lamp unit 20 described above, the driving beam lamp unit 40 mainly differs in that the light shield member 28 is omitted and in that the surface shape of the first reflective surface 22*a* is configured so that the light from the first light source 24*a*, which passes through the first lens portion 26*a* and is emitted forward, forms the condensing region P3 of the driving beam light distribution pattern on the virtual vertical screen. And, except for the above described differences, the driving beam lamp unit 40 can have configurations similar to those of the combined passing & driving beam lamp unit 20 described above.

Next, an operation example of the vehicle headlamp 10L of the above configuration (an operation example of switching to the passing beam light distribution pattern, the driving beam light distribution pattern, or the daytime running lamp light distribution pattern) will be described.

Switching to the passing beam light distribution pattern, the driving beam light distribution pattern, or the daytime running lamp light distribution pattern can be performed by a control circuit (not illustrated) such as an ECU (electronic control unit) electrically connected to each lamp unit 20, 40 (each light source 24*a*, 24*b*).

The control circuit switches to the passing beam light distribution pattern, the driving beam light distribution pattern, or the daytime running lamp light distribution pattern by individually controlling (for example reducing IF (for example, forward current) or controlling a pulse) a lighting state (on or off) of each lamp unit 20, 40.

For example, when forming the driving beam light distribution pattern, the control circuit can control each lamp unit 20, 40 (each light source 24*a*, 24*b*) so that each first light source 24*a* of each lamp unit 20, 40 turns on and each second light source 24*b* of each lamp unit 20, 40 turns off.

Figure 5C:
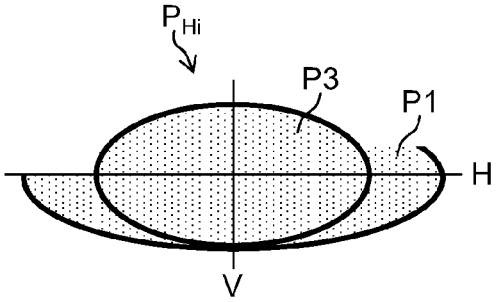
FIG. 5C illustrates an example of a driving beam light distribution pattern PHi formed onto the virtual vertical screen.

By this, the condensing region P3 (see FIG. 5A) in the driving beam light distribution pattern formed by the two driving beam lamp units 40 and the passing beam distribution pattern P1 (see FIG. 5B) formed by the three combined passing & driving beam lamp unit 20 are superimposed, and as illustrated in FIG. 5C, a driving beam light distribution pattern PHi (corresponding to the headlamp light distribution pattern of the presently disclosed subject matter) is formed.

Meanwhile, when forming the passing beam light distribution pattern, the control circuit can control each lamp unit 20, 40 (each light source 24*a*, 24*b*) so that each first light source 24*a* of each lamp unit 20 turns on, each first light source 24*a* of each lamp unit 40 turns off, and each second light source 24*b* of each lamp unit 20, 40 turns off.

By this, the passing beam light distribution patterns P (see FIG. 5B) formed by the three combined passing & driving beam lamp units 20 are superimposed, and the passing beam light distribution pattern (corresponding to the headlamp light distribution pattern of the presently disclosed subject matter) is formed.

Meanwhile, when forming the daytime running lamp light distribution pattern, the control circuit can control each lamp unit 20, 40 (each light source 24*a*, 24*b*) so that each first light source 24*a* of each lamp unit 20, 40 turns off and each second light source 24*b* of each lamp unit 20, 40 turns on.

By this, the daytime running lamp light distribution patterns (see FIG. 5D) formed by each lamp unit 20, 40 are superimposed, and the vertically and horizontally dispersed daytime running lamp light distribution pattern is formed.

As described above, the lamp units 20, 40 of the vehicle headlamp 10L of the present embodiment provide at least the following characteristics and/or advantages.

First, in the lamp units 20, 40 of the vehicle headlamp 10L having a configuration that incorporates the first light source 24*a* used for the first lamp function (for example a headlamp function) and the second light source 24*b* used for the second lamp function (for example a daytime running lamp function) in a single unit, it becomes possible to reduce the number of components, simplify an assembly process, and reduce assembly errors.

The first characteristic/advantage is achieved by not configuring the first lens portion 26*a* and the second lens portion 26*b* as physically separate and individual lenses but configuring as a single lens 26.

Second, the lamp units 20, 40 can realize two lamp functions (the headlamp function and the daytime running lamp function) despite there being only one lens 26 configured.

Furthermore, according to the lamp units 20, 40 of the vehicle headlamp 10L of the present embodiment, the extent of vertical and horizontal dispersion of the light from the second light source 24*b*, which is emitted forward passing through the second lens portion 26*b*, can be adjusted by adjusting the shape of each lens cut 26*d*.

Furthermore, according to the lamp units 20, 40 of the vehicle headlamp 10L of the present embodiment, even though the lamp units 20, 40 are configured in appearance to be the single lens 26, the lamp unit can realize two lamp functions. This is because the front side surface of the lens 26 is configured as a common single lens surface where the front side surface 26*a*2 of the first lens portion 26*a* and the front side surface 26*b*2 of the second lens portion 26*b* continue smoothly.

Furthermore, according to the lamp units 20, 40 of the vehicle headlamp 10L of the present embodiment, the glare caused by a portion of light from the second light source 24*b* passing through the first lens portion 26*a* and being reflected forward and obliquely upward by the second extension 18*b* disposed around the lamp units 20, 40 can be suppressed. This is due to providing the light shielding portion 22*c* that shields at least a portion of the light heading toward the first lens portion 26*a* from the second light source 24*b*.

Furthermore, according to the lamp units 20, 40 of the vehicle headlamp 10L of the present embodiment, the size of the second lens portion 26*b* can be made smaller. As a result, the size of the first lens portion 26*a* can be made larger. This is because the surface shape of the second reflective surface 22*b* is configured so that the light rays (Ray 2) (See FIGS. 6, 7, 8) from the second light source 24*b* reflected by the second reflective surface 22*b* condense forward or rearward of the second lens portion 26*b*.

Next, a modified example will be described.

The above embodiment describes an example where the first lamp function is the headlamp function and the second lamp function is the daytime running light function, but the presently disclosed subject matter is not limited thereto. For example, the first lamp function may be a front fog lamp function, a position lamp function, or another lamp function. Moreover, the second lamp function may be the position lamp function or another lamp function.

The above embodiment is simply an example on all counts. The presently disclosed subject matter is not interpreted to be limiting by these descriptions. The presently disclosed subject matter can be implemented in various other forms without departing from the spirit or the principal features thereof.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A lamp unit, comprising:

a lens shaped as an aspherical lens, the lens including a first lens portion, and a second lens portion thinner in a light emitting direction than the first lens portion and disposed adjacent to the first lens portion, the second lens portion forming a concave portion on at least a part of a rear side surface of the aspherical lens;

a first reflective surface disposed rearward of the first lens portion;

a second reflective surface disposed rearward of the second lens portion;

a first light source configured to emit light which is reflected by the first reflective surface, passes through the first lens portion and is emitted forward; and a second light source configured to emit light which is reflected by the second reflective surface, passes through the second lens portion and is emitted forward, wherein a shape of a rear side surface of the second lens portion is configured so that light from the second light source reflected by the second reflective surface, passing through the second lens portion and emitted forward is diffused vertically and horizontally.

2. The lamp unit according to claim 1, wherein the rear side surface of the second lens portion includes at least one lens cut.

3. The lamp unit according to claim 1, wherein the shape of the rear side surface of the second lens portion is configured so that light from the second light source reflected by the second reflective surface, passing through the second lens portion and emitted forward is diffused vertically and horizontally to form at least a portion of a daytime running lamp light distribution pattern.

4. The lamp unit according to claim 3, wherein a shape of the first reflective surface is configured so that light from the first light source emitted forward through the first lens portion forms at least a portion of a headlamp light distribution pattern.

5. The lamp unit according to claim 1, wherein a shape of the first reflective surface is configured so that light from the first light source emitted forward through the first lens portion forms at least a portion of a headlamp light distribution pattern.

6. The lamp unit according to claim 1, wherein a front side surface of the lens is configured so that a front side surface of the first lens portion and a front side surface of the second lens portion form a common single lens surface that forms a continuous convex surface.

7. The lamp unit according to claim 6, further comprising a light shielding portion configured to shield at least a portion of light from the second light source directed to the first lens portion.

8. The lamp unit according to claim 6, wherein the shape of the second reflective surface is configured so that light from the second light source reflected by the second reflective surface condenses forward or rearward of the second lens portion.

9. The lamp unit according to claim 1, further comprising a light shielding portion configured to shield at least a portion of light from the second light source directed to the first lens portion.

10. The lamp unit according to claim 9, wherein the shape of the second reflective surface is configured so that light from the second light source reflected by the second reflective surface condenses forward or rearward of the second lens portion.

11. The lamp unit according to claim 1, wherein the shape of the second reflective surface is configured so that light from the second light source reflected by the second reflective surface condenses forward or rearward of the second lens portion.

12. The lamp unit according to claim 1, wherein the first light source is configured to direct light in an upward direction about a first light emitting axis, and the second light source is configured to direct light in a downward direction substantially opposed to the upward direction and about a second light emitting axis.

13. The lamp unit according to claim 12, wherein the first light source is located rearward and further from a center of the lens than the second light source.

14. The lamp unit according to claim 12, wherein the first reflective surface and second reflective surface are incorporated into a single continuous homogenous structure that extends from the first light source to the second light source and intersects both the first light emitting axis and second light emitting axis.

15. The lamp unit according to claim 1, wherein the first lens portion and second lens portion are incorporated into a single continuous homogenous structure.

16. The lamp unit according to claim 15, wherein the first lens portion has a rear surface that is substantially flat in shape.

17. The lamp unit according to claim 1, wherein the first lens portion has a rear surface that is substantially flat in shape.

18. A vehicle, comprising:

a headlight configured to direct light along a light emitting direction located in front of the vehicle, including:

a lens with a first lens portion and a second lens portion, the second lens portion having a total thickness in the light emitting direction thinner than a total thickness of the first lens portion in the light emitting direction, the second lens portion including a concave portion on a rear surface of the second lens portion;

a first reflective surface disposed rearward of the first lens portion;

a second reflective surface disposed rearward of the second lens portion;

a first light source configured to emit light along an axis that intersects the first reflective surface; and a second light source configured to emit light along a second axis that intersects the second reflective surface, wherein a shape of the rear surface of the second lens portion is configured so that light from the second light source passes through the second lens portion and is diffused vertically and horizontally.

19. A lamp unit configured to emit light along a light emitting direction, comprising:

a lens having a first lens portion and a second lens portion, the second lens portion having a total thickness in the light emitting direction thinner than a total thickness of the first lens portion in the light emitting direction, the second lens portion including a concave portion on a rear surface of the second lens portion, the lens further including a front surface opposed to the rear surface of the second lens portion wherein the front surface is configured as a continuous convex surface spanning both the first lens portion and second lens portion;

at least one reflective surface disposed rearward of the lens;

a first light source located adjacent to the at least one reflective surface; and a second light source, wherein the first light source is configured to direct light upward such that the light from the first light source intersects the at least one reflective surface, and the second light source is configured to direct light downward such that the light from the second light source intersects the at least one reflective surface.

* * * * *